US006296195B1

(12) United States Patent
Blank et al.

(10) Patent No.: US 6,296,195 B1
(45) Date of Patent: Oct. 2, 2001

(54) RAIL SYSTEM

(75) Inventors: Helmuth Blank, Seevetal; Bernd Pahl, Hamburg, both of (DE)

(73) Assignee: Phoenix Aktiengesellschaft, Hamburg (DE)

( * ) Notice: Subject to any disclaimer, the term of this patent is extended or adjusted under 35 U.S.C. 154(b) by 0 days.

(21) Appl. No.: 09/529,474

(22) PCT Filed: Oct. 5, 1998

(86) PCT No.: PCT/DE98/02952

§ 371 Date: Apr. 14, 2000

§ 102(e) Date: Apr. 14, 2000

(87) PCT Pub. No.: WO99/20841

PCT Pub. Date: Apr. 29, 1999

(30) Foreign Application Priority Data

Oct. 21, 1997 (DE) ..... 197 46 215

(51) Int. Cl.[7] ..... E01B 9/60

(52) U.S. Cl. ..... 238/2; 238/5; 238/264; 238/283; 238/382

(58) Field of Search ..... 238/2, 3, 4, 5, 238/6, 7, 8, 9, 283, 264, 292, 382, 306, 307, 122, 129

(56) References Cited

U.S. PATENT DOCUMENTS

| | | | | |
|---|---|---|---|---|
| 4,231,908 | * | 11/1980 | Pennino | 260/28.5 AS |
| 4,899,933 | * | 2/1990 | Martin | 238/8 |
| 5,165,598 | * | 11/1992 | Ortwein | 238/283 |
| 5,181,657 | * | 1/1993 | Davis | 238/8 |
| 5,361,986 | * | 11/1994 | Meier et al. | 238/283 |
| 5,735,457 | * | 4/1998 | Bohm et al. | 238/283 |

FOREIGN PATENT DOCUMENTS

| | | | | |
|---|---|---|---|---|
| 933 342 | | 9/1955 | (DE) . | |
| 22 10 741 | | 2/1973 | (DE) . | |
| 33 45 388 | | 6/1985 | (DE) . | |
| 3345388-A1 | * | 6/1985 | (DE) | E01B/21/02 |
| 38 34 329 | | 4/1989 | (DE) . | |
| 3834329-A1 | * | 4/1989 | (DE) | E01B/9/60 |
| 4223270-A1 | * | 1/1994 | (DE) | E01B/9/60 |
| 94 17 436 | | 3/1996 | (DE) . | |
| 9417436U1 | * | 4/1996 | (DE) | E01B/21/00 |
| 2 154 635 | | 9/1985 | (GB) . | |

* cited by examiner

*Primary Examiner*—S. Joseph Morano
*Assistant Examiner*—Frantz F. Jules
(74) *Attorney, Agent, or Firm*—Collard & Roe, P.C.

(57) ABSTRACT

A rail arrangement includes a bullheaded rail having joint ties and a rail head, a rail bridge and a rail foot. There is a driving track made of concrete with an integrated joint, in which the rail is seated in connection with a substrate; as well as profiles made of elastomeric material. The profiles includes a base profile arranged below the foot of the rail and which has flanges on both sides which completely or partially grip around the foot of the rail. The base profile has a plurality of channels having a rhombic cross-sectional shape and extending in the longitudinal direction of the rail, which are arranged in the plane extending parallel with the underside of the foot of the rail. The channels at the edges of the base profile have a smaller cross sectional shape than the channels at the center area. There are two side profiles abutting the rail on both sides. One of the side profiles preferably has a tracking groove on the side of the wheel rim. There is also a joint tie coating.

12 Claims, 1 Drawing Sheet

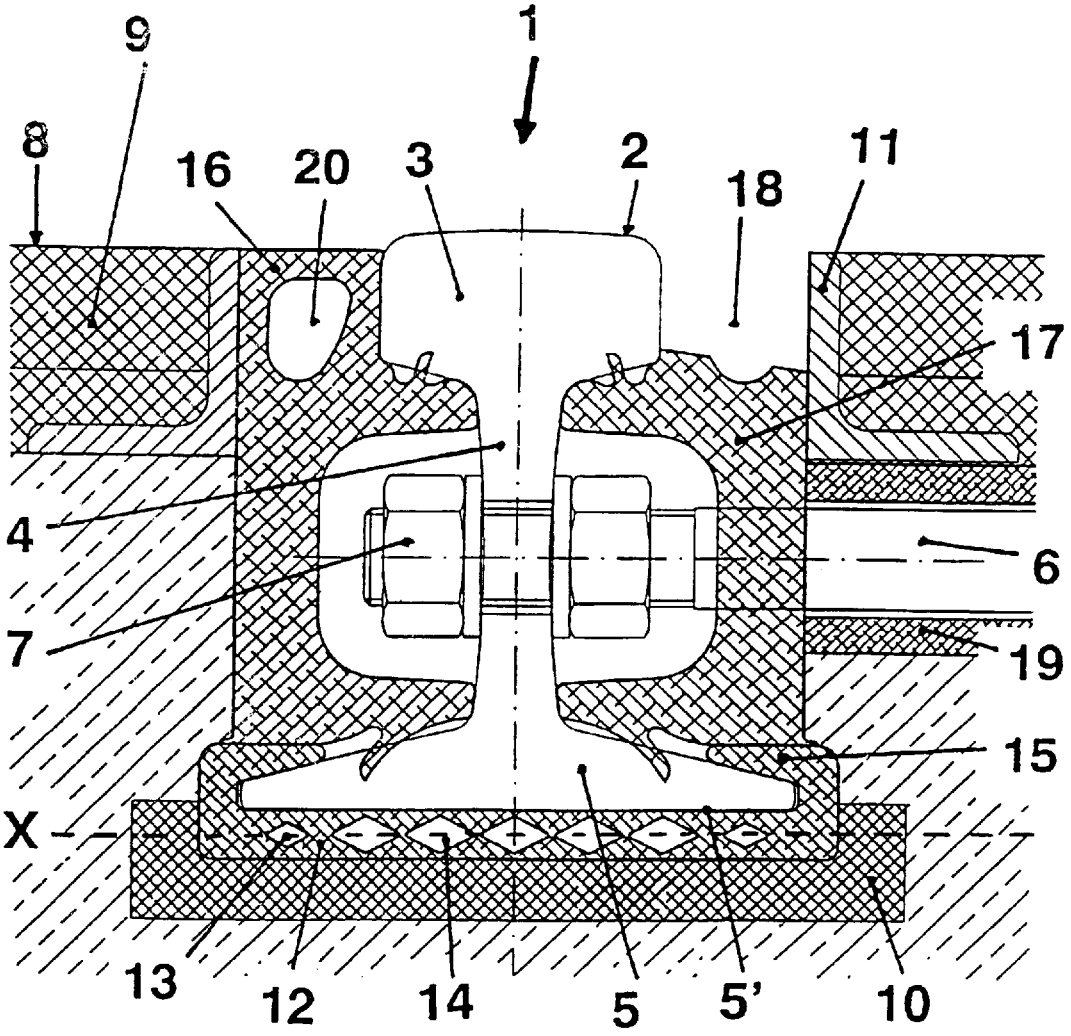
1
2
3
4
5
5'
6
7
8
9
10
11
12
13
14
15
16
17
18
19
20
X

RAIL SYSTEM

CROSS REFERENCE TO RELATED APPLICATIONS

Applicants claim priority under 35 U.S.C. §119 of German Application No. P 197 46 215.4 filed on Oct. 21, 1997. Applicants also claim priority under 35 U.S.C. §120 of PCT/DE98/02952 filed on Oct. 5, 1998. The international application under PCT article 21(2) was not published in English.

BACKGROUND OF THE INVENTION

1. Field of the Invention.

The invention relates to a rail arrangement comprising a rail, in particular a bullheaded rail comprising a rail head, a rail bridge and a rail foot, whereby the rail is provided with joint ties;

a driving track made of concrete or the like, with an integrated joint, in which the rail is seated, in particular in connection with a substrate; as well as profiles made of elastomeric material specifically comprising a base profile, which is arranged below the foot of the rail and provided with flanges on both sides, said flanges completely or partially gripping around the foot of the rail, whereby, furthermore, the base profile has a plurality of channels extending in the longitudinal direction of the rail, said channels mostly being arranged in the plane extending parallel with the underside of the foot of the rail;

two side profiles abutting the rail on both sides, whereby the side profile, if a bullhead rail is employed, preferably has a tracking groove on the side of the wheel rim; as well as a joint tie coating.

2. The Prior Art

Based on the state of the art of a rail arrangement of the type specified above, as it is described, for example in published patent document DE 33 45 388 A1, the problems consists in providing a rail arrangement which, within the framework of communal traffic, permits a stroke of about up to 1.5 mm; which reduces tilting of the rail; as well as assures the mobility of the joint tie. Furthermore, the goal is to minimize the creeping current component and voltage corrosion.

SUMMARY OF THE INVENTION

Said problem is solved according to the characterizing part of claim 1 in that the channels of the base profile have a rhombic cross sectional shape, whereby the channels located in the two edge areas of the base profile have a smaller cross section than the channels located in its center area, which causes the rigidity of the base profile to increase outwardly; and in that the base profile, the two side profiles and the joint tie coating consist of an electrically insulating elastomeric material.

Useful developments of the rail arrangement as defined by invention are specified in claims 2 to 13.

BRIEF DESCRIPTION OF THE DRAWING

Now, the invention is explained in the following with the help of an exemplified embodiment and by reference to a schematic drawing (cross sectional representation), specifically in connection with the following list of reference numerals and letters:

1 Rail arrangement
2 Bullheaded rail
3 Rail head
4 Rail bridge
5 Rail foot
5' Underside of rail foot
6 Joint tie
7 Joint tie fastening
8 Driving track
9 Track surfacing
10 Substrate
11 Steel section
12 Base profile (foot profile)
13 Channels in the two edge areas of the base profile
14 Channels in the center area of the base profile
15 Flange
16 Side profile
17 Side profile
18 Tracking groove (part of the rail chamber)
19 Joint tie coating
20 Channel
X Plane of channels

DETAILED DESCRIPTION OF THE PREFERRED EMBODIMENT

The rail arrangement 1 according to the drawing comprises a base profile 12 made of elastomeric material. Said base profile is arranged below the rail foot 5 and provided on both sides with the flanges 15, which completely or partially grip around the foot of the rail. Furthermore, the base profile has a plurality of channels 13 and 14 extending in the longitudinal direction of the rail and being arranged in a plane X extending parallel with the underside 5' of the foot of the rail. In this connection, the channels have a rhombic cross-sectional shape (in the unloaded condition), whereby the total of the two channels 13 in the two edges areas of the base profile 12 have a smaller cross-sectional shape than the five channels 14 located in the center area of said base profile, said channels having the same cross sections. The spacing between the channels 13 and 14, which have different cross sections, is in this connection greater than the spacing between the channels 14 having equal cross sections. Furthermore, the channels are exclusively arranged in the region below the underside 5 of the foot of the rail, whereas the area of the base profile 12 located outside of the rail foot 5, where the base profile changes into the flanges, has no channels.

The base profile 12 continuously supports the rail. Tilting of the rail is reduced owing to the fact that the rigidity of the said base profile increases outwards, which has a positive effect on the driving level.

Furthermore, the rail arrangement 1 comprises the two side profiles 16 and 17 made of elastomeric material. Said side profiles are driven into the joint (rail chamber). Said side profiles are adequately rigid for producing any desired type of upper structure, on the one hand, and sufficiently soft, on the other hand, that the stroke of the rail will not be obstructed.

At the level of the rail head 3, the side profile 16 is provided with a channel 20 extending in the longitudinal direction of the rail, which increases the elasticity in said region. The side profile 17, however, is provided with a tracking groove 18 located on the side of the wheel rim, which reduces the susceptibility to wear.

Furthermore, the rail arrangement 1 is provided with a joint tie coating 19 made of elastomeric material, which assures the mobility of the joint tie 6.

The base profile 12, the two side profiles 16 and 17 as well as the joint tie coating 19 consist of an electrically insulating elastomeric material, whereby the following material parameters usefully apply:

Base profile 12: Material EPDM Carbon black component maximally 17% by weight; light filler component at least 15% by weight; or Material NR, in particular NR/SBR or NR/BR; carbon black component maximally 17% by weight.

Side profiles 16 and 17 and joint tie coating 19: material SBR or SBR/BR; carbon black component maximally 24% by weight; light filler component at least 6% by weight.

The creeping current component and the voltage corrosion are particularly effectively minimized on account of said material-specific measures.

Furthermore, within the area of connection with the two side profiles 16 and 17, the track surfacing 9 is on both sides equipped with the steel sections 11, the latter in particular having an L-shaped cross section, which stabilizes the surfacing of the rail track.

What is claimed is:

1. A rail arrangement (1) consisting of a rail (2) comprising a rail head (3) a rail bridge (4) and a rail foot (5), whereby the rail is provided with joint ties (6);

a driving track (8) made of concrete, with an integrated joint in which the rail is seated in connection with a substrate (10); as well as Profiles made of elastomeric material specifically consisting of a base profile (12), which is arranged below the rail foot (5) and provided on both sides with flanges completely or partially gripping around the rail foot, whereby, furthermore, the base profile has a plurality of channels (13, 14) extending in the longitudinal direction of the rail, said channels mostly being arranged in a plane (X) extending parallel with the underside (5') of the foot of the rail;

two side profiles (16, 17) abutting the rail on both sides, one of said side profiles being located on the side of a wheel rim, and whereby when a bullheaded rail is used, said one side profile (17) located on the side of the wheel rim preferably has a tracking groove (18); as well as a joint tie coating (19);

characterized in that the channels (13, 14) of the base profile (12) have a rhombic cross-sectional shape, whereby the channels (13) in two edge areas of the base profile have a smaller cross-sectional shape than the channels (14) located in a center area of said base profile, causing the rigidity of the base profile to increase outwardly; and that the base profile (12), the two side profiles (16, 17) and the joint tie coating (19) consist of an electrically insulating elastomeric material; and the channels (13, 14) of the base profile (12) are exclusively arranged in a zone below the underside (5') of the foot of the rail, whereas there are none of said channels in the area of the base profile located outside of the rail foot (5), where the base profile changes into the flanges (15).

2. The rail arrangement according to claim 1, characterized in that the base profile (12) has seven channels (13, 14).

3. The rail arrangement according to claim 2, characterized in that the base profile (12) has seven channels (13, 14), whereby two of said channels (13) are located in the two edge areas of the base profile and have a smaller cross-sectional shape than the five other of said channels (14) located in a center area of said base profile, the latter having equal cross sections.

4. The rail arrangement according to claim 1, characterized in that the spacing between two channels (13, 14) with different cross sections is greater than the one between two channels (14) having the same cross sections.

5. The rail arrangement according to claim 1, characterized in that the base profile (12) consists of a rubber mixture based on ethylene-propylene-diene copolymer (EPDM).

6. The rail arrangement according to claim 5, characterized in that the base profile (12) based on EPDM has a carbon black component of maximally 17% by weight and a light filler component of at least 15% by weight as components of the mixture.

7. The rail arrangement according to claim 1, characterized in that the two side profiles (16, 17) and the joint tie coating (19) consist of a rubber mixture based on SBR or a blend of SBR and BR.

8. The rail arrangement according to claim 7, characterized in that the two side profiles (16, 17) and the joint tie coating (19) based on SBR or SBR/BR has maximally 24% by weight carbon black and at least 6% by weight light filler as components of the mixture.

9. The rail arrangement according to claim 1, characterized in that the base profile (12) consists of a rubber mixture based on natural rubber (NR) with styrene-butadiene rubber (SBR) or butadiene rubber (BR).

10. The rail arrangement according to claim 9, characterized in that the base profile (12) has maximally 17% by weight carbon black as component of the mixture.

11. The rail arrangement according to claim 1, characterized in that the electrically insulating property of the elastomeric material is effected by reducing the carbon black component and/or by adding a light filler.

12. The rail arrangement according to claim 1, characterized in that within the area of connection with the two side profiles (16, 17), the driving track surfacing (9) is equipped on both sides with steel sections (11) having an L-shaped cross section.

* * * * *